US006175265B1

(12) United States Patent
Ueno

(10) Patent No.: US 6,175,265 B1
(45) Date of Patent: Jan. 16, 2001

(54) CURRENT SUPPLY CIRCUIT AND BIAS VOLTAGE CIRCUIT

(75) Inventor: Naoki Ueno, Tochigi-ken (JP)

(73) Assignee: Nippon Precison Circuits Inc., Tokyo (JP)

( * ) Notice: Under 35 U.S.C. 154(b), the term of this patent shall be extended for 0 days.

(21) Appl. No.: 09/226,952

(22) Filed: Jan. 8, 1999

(30) Foreign Application Priority Data

Jan. 9, 1998 (JP) ..... 10-3313

(51) Int. Cl.[7] ..... G05F 1/10

(52) U.S. Cl. ..... 327/540; 327/538; 327/539; 323/315; 323/316

(58) Field of Search ..... 327/538, 539, 327/540; 323/315, 316

(56) References Cited

U.S. PATENT DOCUMENTS 4,319,180 3/1982 Nagano ..... 323/313
4,736,125 4/1988 Yuen ..... 326/78
5,563,502 * 10/1996 Akioka et al. ..... 323/313

FOREIGN PATENT DOCUMENTS 40450830 10/1991 (EP) .
50524154 1/1993 (EP) .
4104517 4/1992 (JP) .

* cited by examiner

*Primary Examiner*—Kenneth B. Wells
*Assistant Examiner*—Cassandra Cox
(74) *Attorney, Agent, or Firm*—Amster, Rothstein & Ebenstein

(57) ABSTRACT

A current supply circuit and bias voltage circuit is realized which is not dependent on temperature. A current supply circuit that operates independent of temperature is configured such that a control voltage is generated by amplifying a base-to-emitter voltage of a first transistor so that the control voltage is applied to a base of a second transistor for supplying an output current to a load connected to a collector. In an alternate bias voltage circuit embodiment, an output voltage that is not dependent on temperature is generated by a voltage drop due to a collector resistor connected to the collector of the second transistor.

2 Claims, 5 Drawing Sheets

OUTPUT CURRENT V. TEMPERATURE CHARACTERISTIC
FOR CONVENTIONAL CURRENT SUPPLY CIRCUIT

OUTPUT CURRENT V. TEMPERATURE FOR CURRENT SUPPLY CIRCUIT

CURRENT SUPPLY CIRCUIT AND BIAS VOLTAGE CIRCUIT

BACKGROUND OF THE INVENTION

1. Field of the Invention

The present invention relates to a current supply circuit and a bias voltage circuit.

2. Description of the Prior Art

FIG. 1 shows one example of a conventional current supply circuit 102. As shown in FIG. 1, a first transistor 106 has an emitter 108 connected to a power supply terminal ground 124 through a first resistor 110 and a first collector 112 connected to a power supply terminal VCC 104 through a load. By applying a control voltage to a base of first transistor 106, a collector current which is dependent on the control voltage is supplied to a load. The control voltage is created by a combination of a base-to-emitter voltage of a transistor 114 and a voltage caused by a current flowing through a second resistor 118.

In addition, conventional current supply circuit 102 includes a bias voltage circuit. The bias voltage circuit includes a third resistor 122 that is connected to first collector 112 of first transistor 106. The bias voltage circuit generates an output voltage utilizing a voltage drop by third resistor 122 at the connection point between third resistor 122 and first collector 112.

There are various designs of current sources applicable to the circuit of FIG. 1, which have a positive temperature coefficient. In such cases, the output current varies corresponding to the temperature coefficient, as shown in FIG. 2. That is, the output current supplied to the load greatly depends upon temperature, as shown in FIG. 2. Furthermore, the output current has a temperature characteristic strongly reflecting an effect of a first term of the temperature coefficient, which increases the value of current supplied to the load as temperature rises.

Also, the bias voltage from such a current has a high temperature dependency which causes difficulty in control because the output current is determined by the collector current.

SUMMARY OF THE INVENTION

In the present invention a current supply circuit is configured such that a base-to-emitter voltage of a first transistor is amplified to generate a control voltage so that the control voltage is applied to a base of a second transistor. The control voltage is applied to the base of the second transistor to supply an output current to a load connected to a collector of the second transistor resulting in an output current that is not temperature dependent. That is, the base-to-emitter voltage of the first transistor with a negative temperature coefficient is amplified to provide a control voltage, which offsets an increase in positive temperature-coefficient output current, thus providing a flat temperature characteristic.

A current supply circuit is configured by comprising: a first transistor having a collector connected to a first potential and an emitter connected to a second potential; an amplifying circuit for amplifying a base-to-emitter voltage of the first transistor to generate a control voltage; and a second transistor having an emitter connected to the second potential through a first resistor, a base at which the control voltage is received, and a collector connected with a load supplied with an output current.

In an additional embodiment of the present invention, similar control can be performed in a bias voltage circuit. A bias voltage circuit is preferably configured by comprising: a first transistor having a collector connected to a first potential and an emitter connected to a second potential; an amplifying circuit for amplifying a base-to-emitter voltage of the first transistor to generate a control voltage; a second transistor having an emitter connected to the second potential through a first resistor and a base at which the control voltage is received, wherein a bias voltage is generated by a voltage drop caused due to a second resistor, connected to the collector of the second transistor.

BRIEF DESCRIPTION OF THE DRAWINGS

The invention is described in further detail relative to preferred embodiments and the drawings which include like reference symbols to refer to the same or similar constituent components, wherein.

DETAILED DESCRIPTION OF THE PREFERRED EMBODIMENTS

Figure 3:
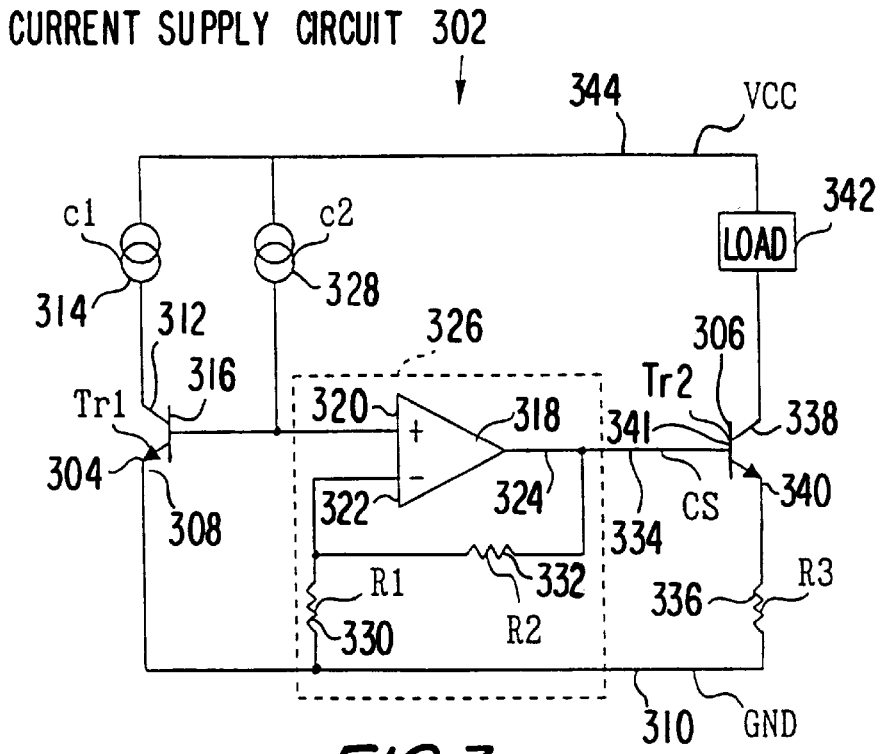
FIG. 3 is a block diagram of a current supply circuit according to an embodiment of the present invention.

FIG. 3 is a block diagram of a current supply circuit 302 which is one embodiment of the present invention. Current supply circuit 302 of FIG. 3 comprises two transistors 304 and 306, an amplifying circuit 326, two current sources 314 and 328, two resistors 330 and 332, a power source VCC 344, and a load 342.

Transistor (Tr1) 304 and transistor (Tr2) 306 are NPN-type bipolar transistors. Amplification circuit 326 is described in further detail with respect to FIG. 4. Current sources 314 and 328 are any sources of electrical current known to those skilled in the art. For example a current source may be a transistor having its collector connected via a resistor to its base and a connection to a power supply terminal VCC. Resistors 330 and 332 are each one or more connected resistor(s) such as those known in the art or any other combination of electrical components providing resistance capability. Power supply VCC 344 is illustrated as a 5 volt power supply but may be implemented with a power supply providing alternate voltage and power levels. Load 342, may be any load including one or more transistors, resistors, capacitors, such as load circuits known to those skilled in the art.

Transistor (Tr1) 304 has an emitter 308 connected to a power supply terminal GND 310 (0 V), and a collector 312 connected to a power supply terminal VCC (5 V) through current source (c1) 314.

Transistor (Tr1) is connected via its base 316 to the positive phase input 320 of operational amplifier 318 within amplifying circuit 326. Operational amplifier 318 may be any operational amplifier or configuration of electrical components providing amplification similar to operational amplifiers known to those skilled in the art. Reverse input 322 is connected to the power supply terminal GND 310 via resistor (R1) 330. Furthermore, reverse input 322 is connected via resistor (R2) 332 to its output 324 and a terminal CS 334.

Resistor 330 has a value of (R1)and resistor 332 has a value of (R2). Therefore, amplifying circuit 326 serves to generate, onto the terminal CS 334, a control voltage of (R1+R2)/R1 times greater than the base-to-emitter voltage of transistor 304 with reference to the power supply terminal GND 310.

Transistor 306 has a base 341 connected to the terminal CS 334, an emitter 340 connected to the power supply terminal GND 310 through a resistor (R3) 336, and a collector connected to the power supply terminal VCC 344 via load 342. The transistor 306 supplies as an output current a collector current to the load 342.

Figure 1:
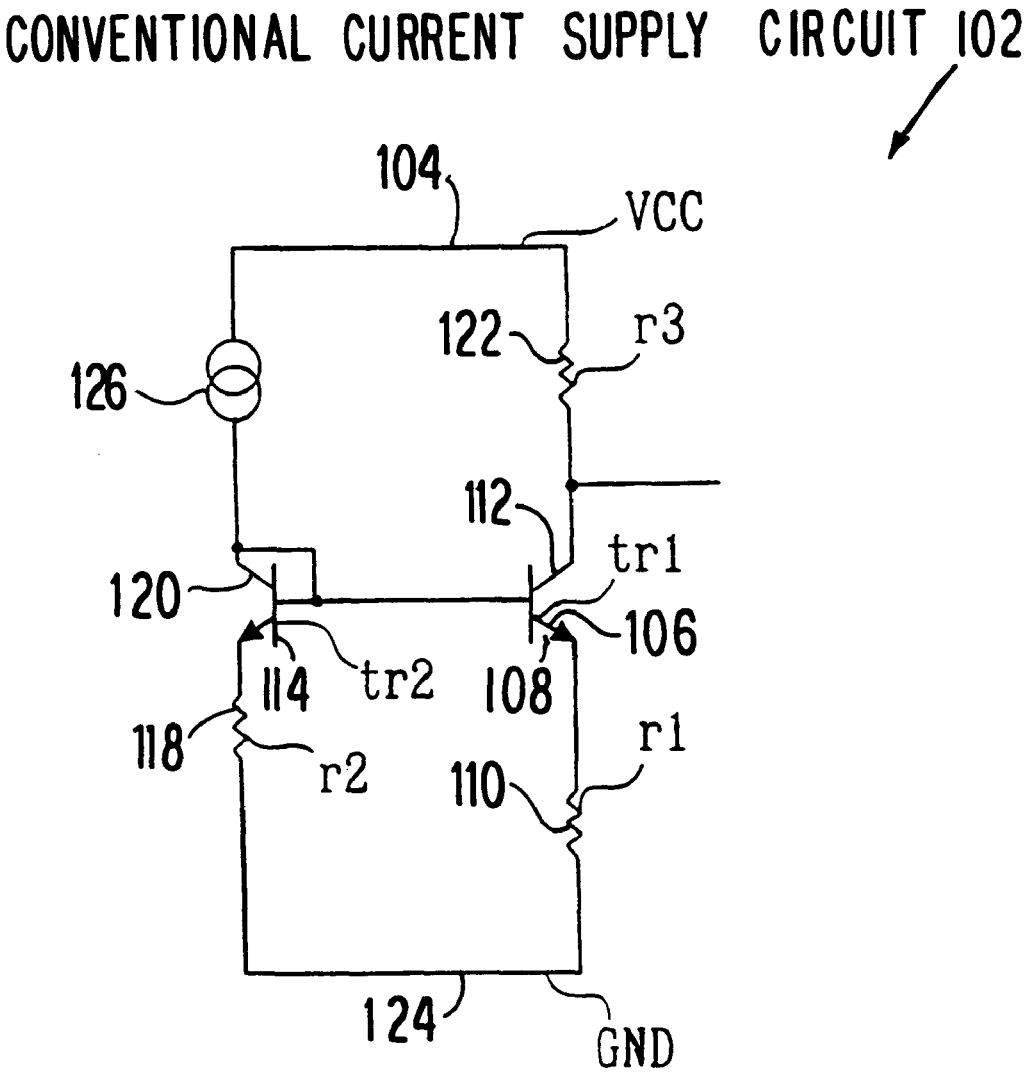
FIG. 1 PRIOR ART
FIG. 1 is a block diagram of a conventional current supply circuit.
Figure 2:
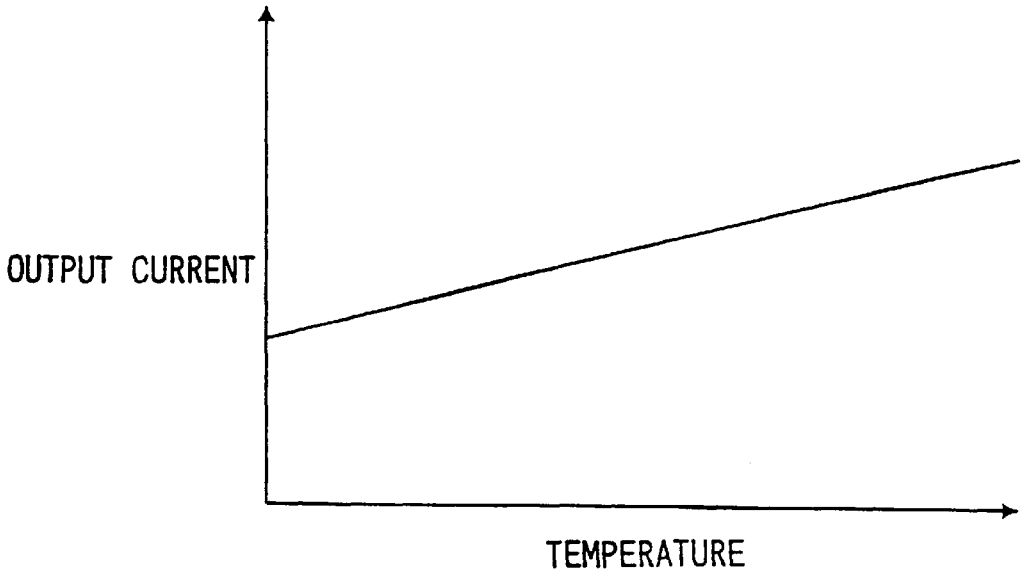
FIG. 2 PRIOR ART
FIG. 2 is a graph of output current vs. temperature characteristic for the conventional current supply circuit.
Figure 5:
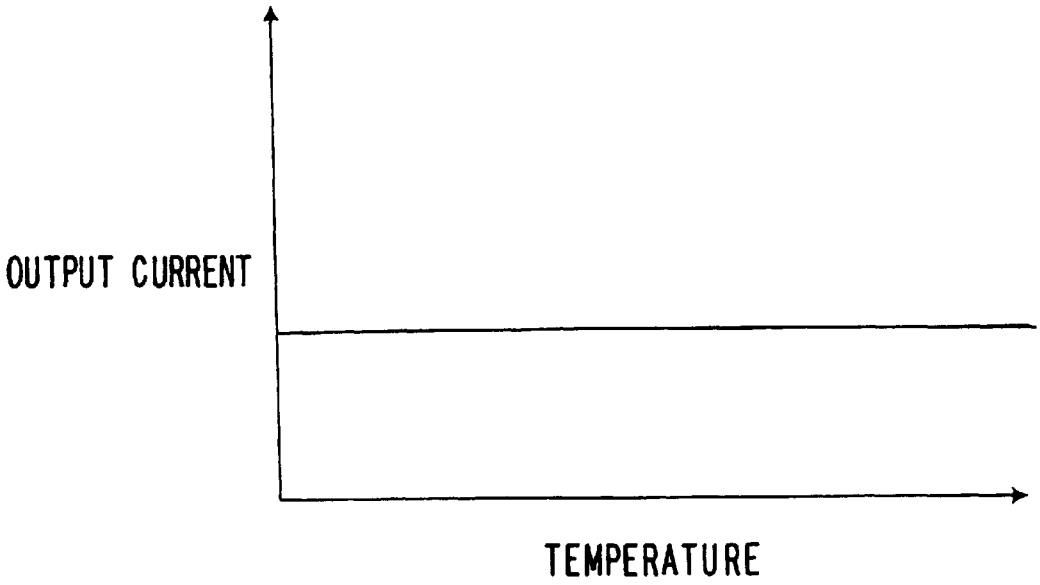
FIG. 5 is a graph of output current vs. temperature characteristic for the current supply circuit according to the embodiment of the present invention shown in FIG. 3.

When the current (collector current of transistor 304) from the current source 314 has a positive temperature coefficient (primary temperature coefficient is positive) as was illustrated with respect to conventional current supply circuit 102 in FIG. 2, if the base-to-emitter voltage of transistor (Tr1) 304 is amplified, the negative temperature coefficient (primary temperature coefficient is negative) corrects for the temperature characteristic of the collector current of the transistor 306. Accordingly, the values (R1) and (R2) of the resistors 330 and 332 are selected based on the temperature characteristic of the collector current of the transistor 306, to provide amplification of the base-to-emitter voltage of the transistor (Tr1) 304 and obtain a control voltage that is applied to the base of transistor 306 (connected in series with resistor (R3) 336) which corresponds to a temperature characteristic that is corrected. Thus an output current is obtained that has a flat temperature characteristic as shown in FIG. 5. The temperature characteristic of resistors 330 and 332 does not affect the overall temperature characteristic because the resistance value of the resistors (R1 and R2) is sufficiently small as compared with that of the transistor.

Also, if a higher amplification is provided by amplifying circuit 326 than that set to obtain the characteristic shown in FIG. 5, it is possible to obtain an output current that falls as the temperature rises. That is, in the present embodiment it is possible to control the output current temperature characteristic negatively relative to the collector current temperature characteristic of the transistor (Tr2) 306 by appropriately selecting the resistance values (R1) and (R2).

Figure 4:
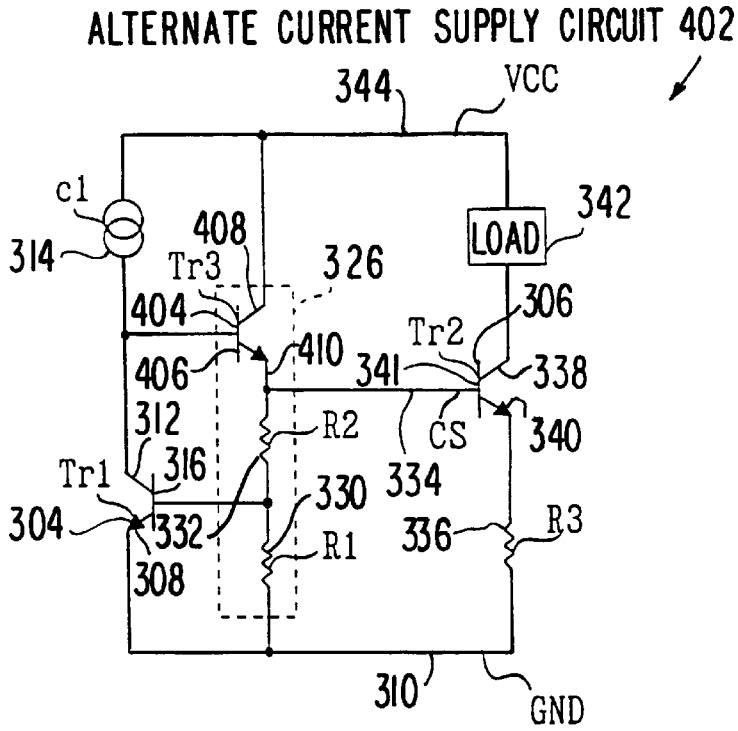
FIG. 4 is a block diagram of an alternate current supply circuit according to an embodiment of the present invention.

FIG. 4 is a block diagram of an alternate current supply circuit 402. Alternate current supply circuit 402 provides an alternate embodiment of amplifying circuit 326. Although explanation of the present invention was described in FIG. 3 with respect to operational amplifier 318 within amplifying circuit 326 providing amplification, amplifying circuit 326 can be implemented by any configuration of electrical components capable of providing amplification known to those skilled in the art such as the alternate configuration shown in FIG. 4.

Amplifying circuit 326 comprises transistor (Tr3) 404 and resistors (R1) 330 and (R2) 332. Similar to transistors shown in FIG. 3, transistor (Tr3) 404 may be implemented as an NPN-type bipolar transistor. Transistor (Tr3) 404 has a base 406 which is connected to a current source (c1) 314, a collector 408 which is connected to a power supply terminal VCC (344), and an emitter 410 which is connected to a terminal CS 334 and to a base of the transistor (Tr1) 304 via resistor (R2) 332. Also, resistor (R1) 330 is connected between a connection point of the resistor (R2) 332 and the base 316 and a power supply terminal GND 310. The emitter 410 of the transistor (Tr3) 404 is connected to the power supply terminal GND 310 through the resistor (R2) 332 and resistor (R1) 330.

As was described with respect to FIG. 3, the base-to-emitter voltage is multiplied by (R1+R2)/R1 to generate a control voltage on the terminal CS 334. Therefore, operation of FIG. 4 provides similar benefits of control as was described with respect to FIG. 3.

In addition to the embodiments described above, alternate embodiments of the present invention may be implemented in bias voltage circuits. Embodiments with such configurations will be explained with respect to FIGS. 6 and 7.

Figure 6:
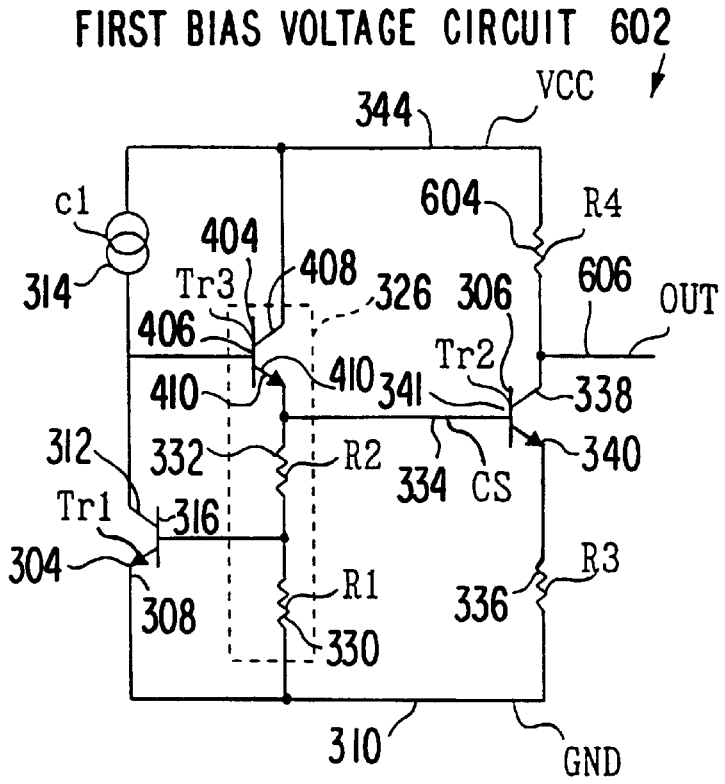
FIG. 6 is a block diagram of a first bias voltage circuit according to an embodiment of the present invention.

FIG. 6 is a block diagram of a first bias voltage circuit 602 according to an alternate embodiment of the present invention. The components and connections of first bias voltage circuit 602 shown in FIG. 6 are the same as those of alternate current supply circuit 402 shown in FIG. 4 with the exception of the components between power supply terminal VCC 344 and collector 338 of transistor (Tr2) 306. In the first bias voltage circuit 602 shown in FIG. 6, power supply terminal VCC 344 is connected to resistor (R4) 604. Resistor (R4) is connected to an output terminal (OUT) 606. The output terminal (OUT) 606 is connected to the collector 338 of transistor (Tr2) 306. The collector current of the transistor (Tr2) 306 at the output terminal (OUT) 606 and the voltage drop due to the resistor (R4) 604 are utilized as a bias voltage. If a temperature characteristic of the collector current of transistor (Tr2) 306 is set with respect to the temperature characteristic of the resistor (R4) 604, it is possible to produce a bias voltage with a flat temperature characteristic.

Figure 7:
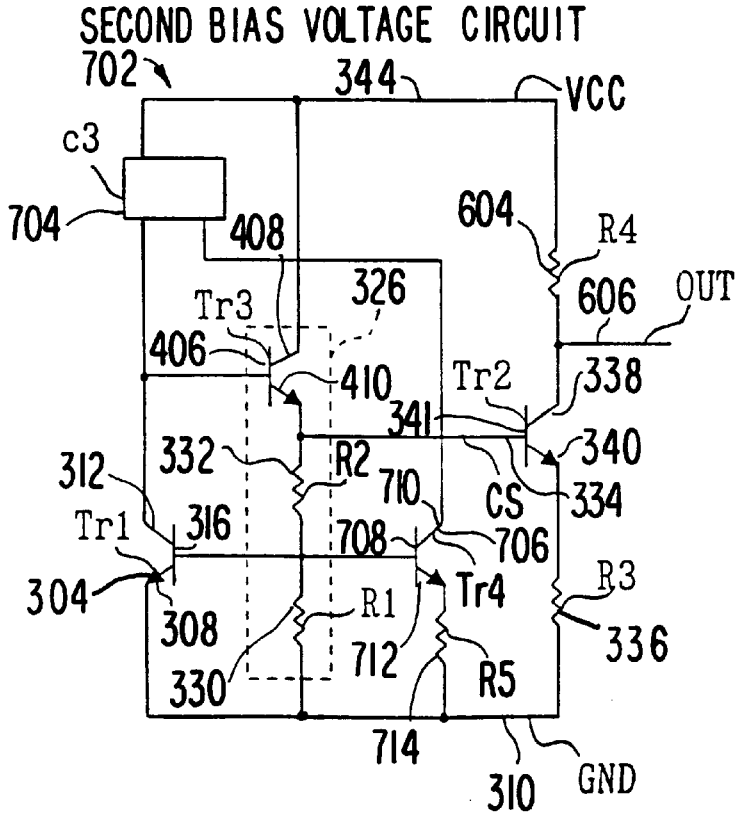
FIG. 7 is a block diagram of a second bias voltage circuit according to an embodiment of the present invention.

FIG. 7 is a block diagram of a second bias voltage circuit 702 according to an alternate embodiment of the present invention. The components and connections of second bias voltage circuit 702 shown in FIG. 7 are the same as those of first bias voltage circuit 602 shown in FIG. 6 with the exception that FIG. 7 does not include the current source (c1) 314 and does include three additional components for control.

The three additional components of second bias voltage circuit 702 are collector current proportional control circuit (c3) 704, transistor (Tr4) 706, and resistor (R5) 714. Transistor (Tr4) 706 is an NPN-type bipolar transistor and resistor (R5) 714 is a resistor such as those described in the above-mentioned embodiments. Collector current proportional control circuit (c3) 704 maintains a collector current ratio of the transistor (Tr1) 304 and transistor (Tr4) 706 constant.

The transistor (Tr4) 706 has a base 708 connected to a base 316 of transistor (Tr1) 304 and an emitter 712 connected to a power supply terminal GND 310 via resistor R5 714. The collector 710 of transistor (Tr4) 706 is connected to collector current proportional control circuit (c3) 704.

A voltage ΔVBE occurs at the ends of the resistor (R5) 714. The voltage ΔVBE is determined by an emitter area ratio and a collector current ratio of the transistor (Tr1) 304 and the transistor (Tr4) 706. The voltage is calculated as $\Delta VBE=(K\cdot T/q)\cdot 1n\ (j1/j4)$, where voltage is ΔVBE, K is Boltzmann's constant, T is absolute temperature and q is electric elementary quantity. The current densities of the transistors (Tr1) 304 and (Tr4) 706 are respectively j1 and j4. The respective collector current values are determined by the values of the voltage ΔVBE and the resistor R. Because the voltage ΔVBE has a positive temperature coefficient, the collector current may also have a positive temperature coefficient. However, if the current is sufficiently increased, the base-to-emitter voltage of the transistor (Tr1) 304 has a negative temperature coefficient. The base-to-emitter voltage is amplified by an amplifying circuit 326 to use as an input to the transistor (Tr2) 306, and an output is taken through the collector of the transistor (Tr2) 306. As a result, the temperature characteristic of the transistor (Tr2) 306 collector current can be controlled toward flat or negative. Thus the bias voltage due to the collector current of the transistor (Tr2) 306 and the voltage drop by the resistor (R4) 604 can be brought to a flat temperature characteristic. If the collector current of the transistor (Tr2) 306 is connected to a load, such as load 342, rather than output terminal (OUT) 606 and resistor (R4) 604, a current supply circuit can be configured.

Further, in FIG. 4 and FIG. 6 the current value of the current source c1 has a direct effect upon an output current or voltage, and the base-to-emitter voltage of the transistor (Tr1) 304 is controlled by $\Delta VBE=(K\cdot T/q)\cdot 1n\ (j1/j4)$. Therefore the effect of variation in power supply voltage may be reduced upon the base-to-emitter voltage, and result in a reduction in variation of power supply voltage for the collector current or bias voltage of the transistor (Tr2) 306. In addition, these embodiments may be used for control on output current or bias voltage.

Although in the above embodiments each transistor was described as an NPN-type bipolar transistor, a PNP-type bipolar transistor may be used. In such a case, the power supply terminal is inverted in polarity.

In the present invention, a current supply circuit is configured such that a base-to-emitter voltage of a first transistor is amplified to generate a control voltage. The control voltage is applied to a base of a second transistor for supplying an output current to a load connected to its collector, whereby the output current obtained is not dependent on temperature. That is, the base-to-emitter voltage of the first transistor with a negative temperature coefficient is amplified to provide a control voltage, which offsets an increase in positive temperature-coefficient output current, thus offering a flat temperature characteristic.

In embodiments using a resistor as a load of an output current generating transistor, in order to use the voltage occurring at the respective ends of the resistor as a bias voltage, an output current temperature characteristic may be set with respect to the temperature characteristic of the load resistance to produce a bias voltage with a flat temperature characteristic. For another bias voltage circuit embodiment, an output voltage may be generated that is not temperature dependent by generating a bias voltage using the voltage drop caused by the second resistance connected to the collector of the second transistor.

Furthermore, a pair of transistors may be connected at their bases with each other and an emitter of one transistor is connected via a resistor to a potential connected to an emitter of the other transistor so that a collector current ratio of the pair of transistors is maintained at a particular value by a collector current ratio control circuit amplifying a base-to-emitter voltage of the other transistor to provide a control voltage. This can reduce an effect of power voltage variation imposed on the control voltage. Such a control voltage, if used as a control voltage of the second transistor, can reduce an effect of power voltage variation on the aforesaid output current and bias voltage. In addition, this configuration is suited for control of the output current and bias voltage.

Although the invention has been described with reference to the preferred embodiments, it will be apparent to one skilled in the art that variations and modifications are contemplated within the spirit and scope of the invention. The drawings and description of the preferred embodiments are made by way of example rather than to limit the scope of the invention, and it is intended to cover within the spirit and scope of the invention all such changes and modifications.

What is claimed is:

1. A current supply circuit, comprising:

a first transistor having an emitter connected to a first potential;

a second transistor having an emitter connected to the first potential through a first resistor and a base connected to a base of said first transistor;

a collector current ratio control circuit for maintaining a collector current ratio of a collector current flowing through a collector of said first transistor to a collector current flowing through a collector of said second transistor at a particular value;

an amplifying circuit for amplifying a base-to-emitter voltage of said first transistor to generate a control voltage; and a third transistor having an emitter connected to the first potential through a second resistor, a base applied by the control voltage, and a collector connected with a load to which an output current is supplied.

2. A bias voltage circuit, comprising:

a first transistor having an emitter connected to a first potential;

a second transistor having an emitter connected to the first potential through a first resistor and a base connected to a base of said first transistor;

a collector current ratio control circuit for maintaining a collector current ratio of a collector current flowing through a collector of said first transistor to a collector current flowing through a collector of said second transistor at a particular value;

an amplifying circuit for amplifying a base-to-emitter voltage of said first transistor to generate a control voltage; and a third transistor having an emitter connected to the first potential through a second resistor and a base applied by the control voltage;

wherein a bias voltage is generated by a voltage drop caused due to a third resistor connected to a collector of said third transistor.

* * * * *